US005161707A

United States Patent [19]

Dutt et al.

[11] Patent Number: 5,161,707

[45] Date of Patent: Nov. 10, 1992

[54] CLOSURE WITH LINERLESS SEAL

[75] Inventors: Herbert V. Dutt, Venetia, Pa.; Gary L. Mengeu, Wheeling, W. Va.

[73] Assignee: Continental Plastics, Inc., Triadelphia, W. Va.

[21] Appl. No.: 839,523

[22] Filed: Feb. 20, 1992

[51] Int. Cl.[5] ..... B65D 53/00

[52] U.S. Cl. ..... 215/344; 215/270; 215/DIG. 1

[58] Field of Search ..... 215/271, 341, 343, 344, 215/345, DIG. 1, 270; 220/240

[56] References Cited

U.S. PATENT DOCUMENTS

| | | | |
|---|---|---|---|
| 3,203,571 | 8/1965 | Plunkett | 215/344 |
| 3,441,161 | 4/1969 | Van Baarn | 215/344 X |
| 3,482,725 | 12/1969 | Exton | 215/344 X |
| 3,990,598 | 11/1976 | Zapp et al. | 215/272 |
| 4,090,631 | 5/1978 | Grussen | 215/329 |
| 4,206,852 | 6/1980 | Dunn et al. | 215/252 |
| 4,322,012 | 3/1982 | Conti | 215/344 |
| 4,566,603 | 1/1986 | Moore | 215/329 |
| 4,574,966 | 3/1986 | Sandhaus | 215/270 |

FOREIGN PATENT DOCUMENTS

| | | | |
|---|---|---|---|
| 2133394 | 7/1984 | United Kingdom | 215/344 |

*Primary Examiner*—Allan N. Shoap
*Assistant Examiner*—Nova Stucker
*Attorney, Agent, or Firm*—Richard V. Westerhoff

[57] ABSTRACT

A linerless closure which provides an effective seal against oxygen penetration and moisture evaporation includes a cap with an inner annular member defining an annular outwardly directed sealing edge which forms a line seal with the inner cylindrical surface of a container wall and an outer annular member defining an annular inwardly directed sealing edge which seals against the outer cylindrical surface of a container wall.

17 Claims, 3 Drawing Sheets

CLOSURE WITH LINERLESS SEAL

BACKGROUND

1. Field of the Invention

This invention relates to container closures and more particularly to such closures having an integral structure which makes a gas and moisture tight seal with the container wall.

2. Background Information

There are packaging applications, such as for example, in the food packaging industry and the craft supplies industry, which have a requirement for a cap which performs acceptably under certain oxygen transmission and moisture evaporation tests. Oxygen contamination or moisture evaporation can spoil the contents of a package not properly sealed to preclude this type of seepage. An example of an oxygen sensitive product is mayonnaise which will spoil over time with oxygen penetration. An example of a product affected by moisture evaporation is a water based craft paint which can dry out before use if the container is not adequately sealed. Another packaging application where there has been difficulty in effecting adequate sealing is plastic containers for carbonated beverages.

Currently metal or plastic caps with internal soft liner seals are used to reduce seepage to an acceptable level or to eliminate oxygen contamination. In addition, various linerless seals have been proposed. Many of these have annular flanges which bear against or fold over the rim of the container. Some form plug seals. These linerless seals are not as effective as the soft liner seals, however, they can be integrally molded with the closure and therefore are less expensive to produce.

We have found that a major detriment to effecting an adequate seal against seepage and oxygen contamination is damage on the container sealing surfaces in the form of scratches and other blemishes caused by tooling or handling equipment.

It is a primary object of the present invention to provide a closure having an effective seal against oxygen contamination and moisture seepage even for containers having scratches or other blemishes on the sealing surfaces and which does not require a soft liner.

SUMMARY OF THE INVENTION

This object and others are realized by the invention which is directed to a closure with a linerless seal and includes a cap having an inner annular member defining an annular outwardly directed sealing edge, and an outer annular member defining an annular inwardly directed sealing edge. The two annular sealing edges are spaced apart radially by a gap which is narrower than the wall thickness of a container to which the cap is applied. Thus, when the cap is threaded onto the container, the container wall is wedged into the gap between the sealing edges so that the outwardly directed sealing edge on the inner annular member seats against and forms an annular line contact seal against the inner cylindrical surface of the container wall and the inwardly directed sealing edge on the outer annular member seats against and forms an annular line contact seal against the outer cylindrical surface of the container wall.

In a preferred embodiment of the invention, the inner annular member is preferably an annular flange extending downwardly and outwardly from the end wall of the cap and has an outer downwardly and outwardly extending frusto-conical surface and a downwardly and inwardly extending frusto-conical end face which intersects the outer face to form the annular outwardly directed sealing edge. Similarly, the outer annular member preferably is an annular flange having an upper, downwardly and inwardly extending frusto-conical surface and a downwardly and outwardly extending frusto-conical end face with intersects the upper surface to form the annular inwardly directed sealing edge. The end faces on the two annular members form lead angles, for guiding the rim of the container into the gap between the sealing edges. Preferably, one of the lead angles, such as the lead angle on the outer annular member, is smaller than the lead angle on the inner annular member, so that the rim contacts the annular members serially rather than both at the same time to reduce the initial resistance to the wedging of the container wall between the sealing edges.

The sealing edges can be, but need not be, aligned horizontally. In one embodiment of the invention particularly useful for glass containers where the inside diameter of the container opening typically has loose tolerances, the inner annular flange is elongated to accommodate for the wider variations in inside diameter of the container opening, and may even have a foot which extends the end face to further accommodate for variations in the size of container openings.

In yet another embodiment of the invention, the end wall of the cap is provided with an annular raised section which forms a downwardly facing annular groove. The inner annular member is formed on an inner annular wall of the groove while the outer annular member is formed on an outer annular wall. Preferably, the confronting annular outwardly directed sealing edge on the inner annular member and the annular inwardly directed sealing edge on the outer annular member are both vertically positioned within the thickness of the end wall so that the stiffness of the end wall assists in resisting the tendency of the container wall to spread the annular members apart. When the closure is to be used with containers storing products under pressure, the center section of the end wall is molded convexly downward, so that the pressure within the container urges the convex section upward causing it to spread laterally thereby increasing the clamping force applied to the sealing edges. If the closure is to be used with vacuum packed products, the center section of the end wall of the cap can be molded in an upwardly convex configuration so that the vacuum pulls the center section downward to again increase the clamping force of the sealing edges.

With the closure of the present invention, the sharp annular sealing edges are effective to create a seal against the inner and outer walls of the container which resists oxygen penetration and moisture evaporation, despite scratches and other blemishes on the sealing surfaces of the container. This effective seal is accomplished with an integrally molded thermoplastic closure.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
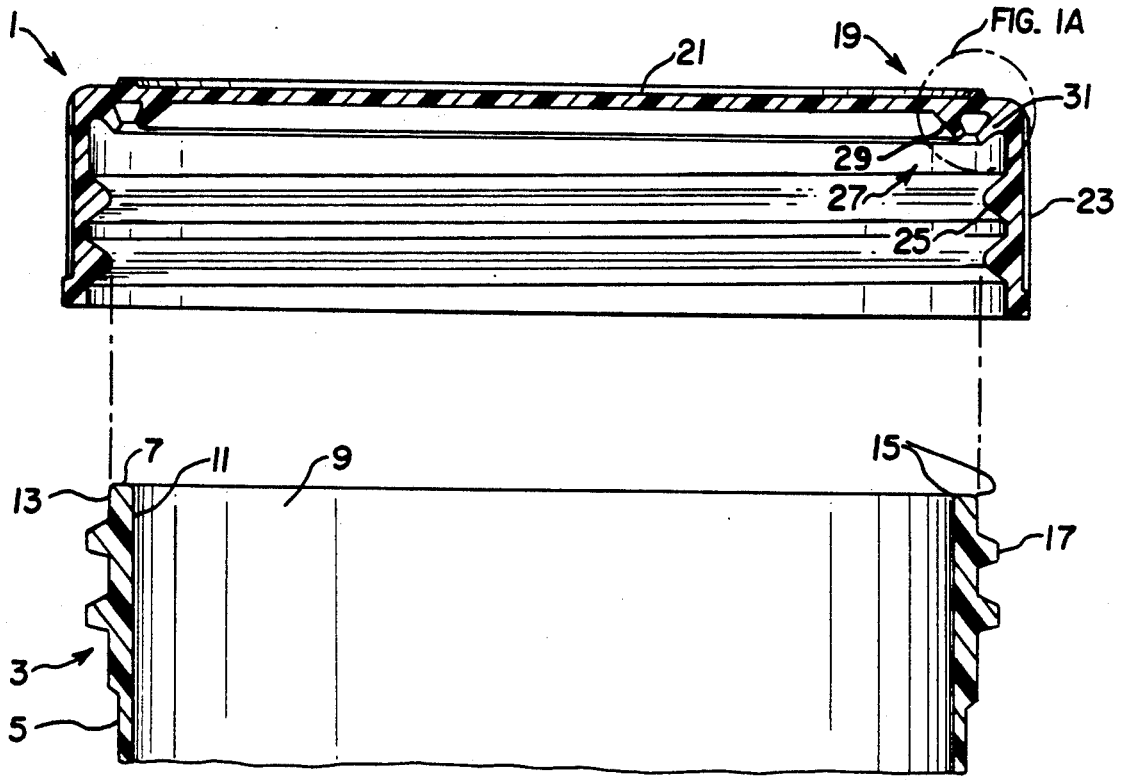
FIG. 1 is a vertical section through a closure in accordance with the invention and the upper portion of a container aligned for application of the closure to the container.
Figure 1A:
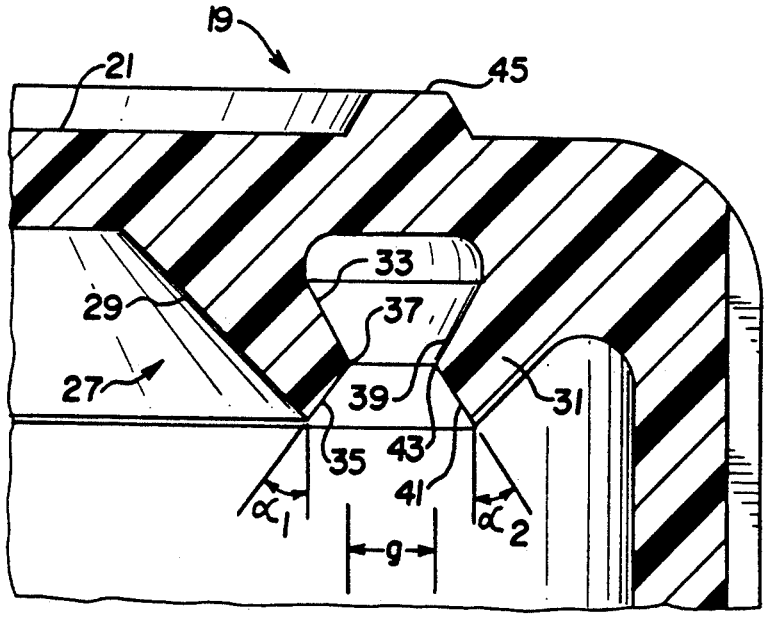
FIG. 1A is an enlargement of a corner of the cross-section through the closure shown in FIG. 1.

Referring to FIGS. 1 and 1A, the closure 1 of the present invention is designed for use with a container 3 having a cylindrical container wall 5 which terminates in a rim 7 defining a container opening 9. The cylindrical container wall has inner and outer sealing surfaces 11 and 13 below the rim 7. A radius 15 is provided at the intersection of the rim 7 with the inner and outer surfaces 11 and 13 of the container wall. A thread 17 is provided on the outer surface of the container wall 5 spaced from the rim 7 below the outer sealing surface 13. The container 3 is molded from a thermoplastic resin and is removed from the mold using a one piece core with air ejection so that the inner and outer diameters of the container wall 5 at the inner and outer sealing surfaces may be held to tight tolerances, preferably about 0.001 to 0.003 inches.

The closure 1 constitutes a cap 19 having a circular end wall 21 and a cylindrical skirt 23 extending downward from the periphery of the end wall. The skirt 23 has internal threads 25 which engage the threads 17 on the container. The closure further includes an integral seal 27 formed by an inner annular member 29 and an outer annular member 31. The inner annular member 29 is a flange which extends downwardly and outwardly from the end wall 21. This flange 29 has an outer, downwardly and outwardly diverging frusto-conical surface 33. A downwardly and inwardly diverging frusto-conical end face 35 intersects the outer frusto-conical surface 33 to form a sharp annular, outwardly directed sealing edge 37. The outer annular member 31 is an inwardly directed flange having a downwardly and inwardly diverging frusto-conical upper surface 39 and a downwardly and outwardly diverging frusto-conical end face 41 which intersect to form an annular inwardly directed sealing edge 43. The confronting sealing edges 37 and 43 are radially spaced apart by a gap g.

Figure 2:
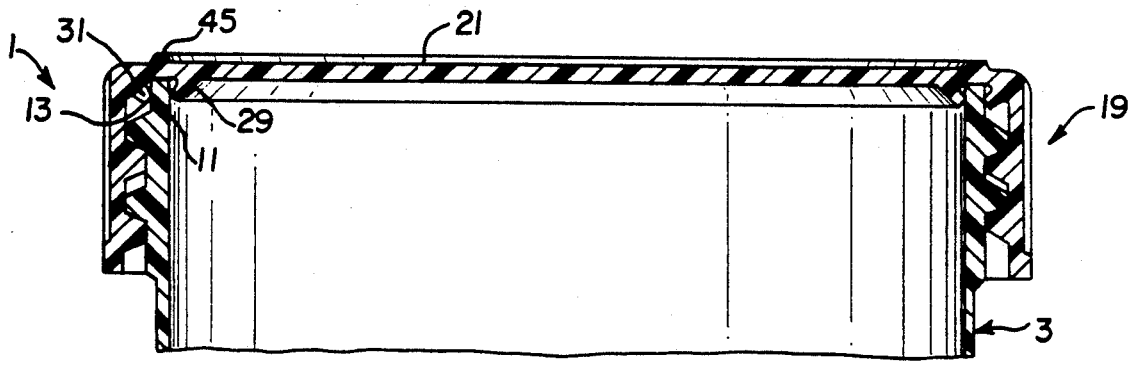
FIG. 2 is a fragmentary vertical section in enlarged scale of the closure of FIG. 1 shown in place on the container.

An annular rib 45, which is trapezoidal in cross section in the closure shown in FIGS. 1, 1A and 2, is molded on the upper surface of the end wall. This rib 45 can engage a similarly dimensioned recess (not shown) in the bottom of the container 3 to facilitate stacking of the containers. This rib which is aligned with the gap g formed between the two annular members 29 and 31 also serves to stiffen the end wall and resist spreading of the annular members apart when the closure is applied to the container.

The upper faces 33 and 39 of the inner annular flange 29 and the outer flange 31, respectively, make an angle of about 60° with the horizontal, while the lower surfaces 47 and 49, respectively, are at an angle of 45° with the horizontal so that the annular flange members taper toward the free ends.

The end face 35 of the flange 29 forms a lead angle $\alpha_1$ while the end face 41 of the flange 31 forms a lead angle $\alpha_2$. In the embodiment of the invention shown, the lead angles $\alpha_1$ and $\alpha_2$ are different and preferably $\alpha_1$ is larger than $\alpha_2$. In the particular embodiment shown $\alpha_1$ is about 38°, while $\alpha_2$ is about 30°. With $\alpha_1$ larger and $\alpha_2$, the rim 7 of the container makes contact with the end face 41 of the outer flange 31 before making contact with the end face 35 of the flange 29. This reduces the initial force required to force the container wall into the gap g between the sealing edges 37 and 43.

FIG. 2 illustrates the closure 1 applied to the container 3. As the threads 25 on the cap 19 engage the thread 17 on the container 3, the cylindrical wall 5 of the container is wedged between the annular flanges 29 and 31. The gap g is dimensioned so that there is about 0.007 in. interference between the sealing edges 37, 43 and the inner and outer cylindrical surfaces 11 and 13, respectively, of the container wall 5. As mentioned above, the rim 7 of the wall 5 engages the end face 41 of the flange 31 before engaging the end face 35 so that the additional force required to apply the cap is increased in steps rather than all at once. The wedging of the container wall into the gap g is resisted by the downwardly converging annular flanges 29 and 31 to force the sealing edges 37 and 43 into tight line contact with the inner surface 11 and outer surface 13, respectively, of the cylindrical container wall 5. The sharp sealing edges 37 and 43 pressed against the inner and outer surfaces of the container wall by the wedging action provide an airtight seal even when there are scratches, tool marks or other blemishes in the sealing surfaces 11 and 13.

Figure 3:
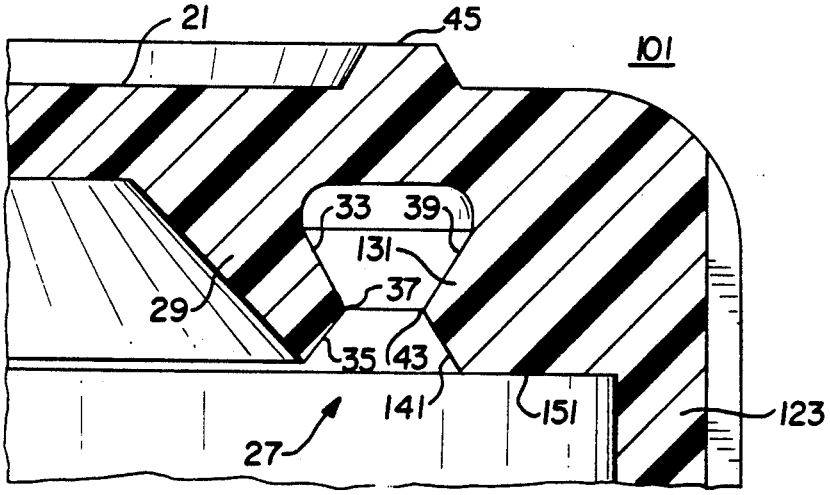
FIG. 3 is a fragmentary vertical section through another embodiment of the closure of FIG. 1.

FIG. 3 illustrates another embodiment of the closure 101 which differs from the closure 1 of FIGS. 1, 1A and 2 in that the outer annular member 131 has a bottom surface 151 which extends radially outward from the lower end of the end face 41 to the skirt 23. The remaining elements of the closure 101 are identical to those of the closure 1 of FIGS. 1 and 2, and therefore are identified by like reference characters.

Figure 4:
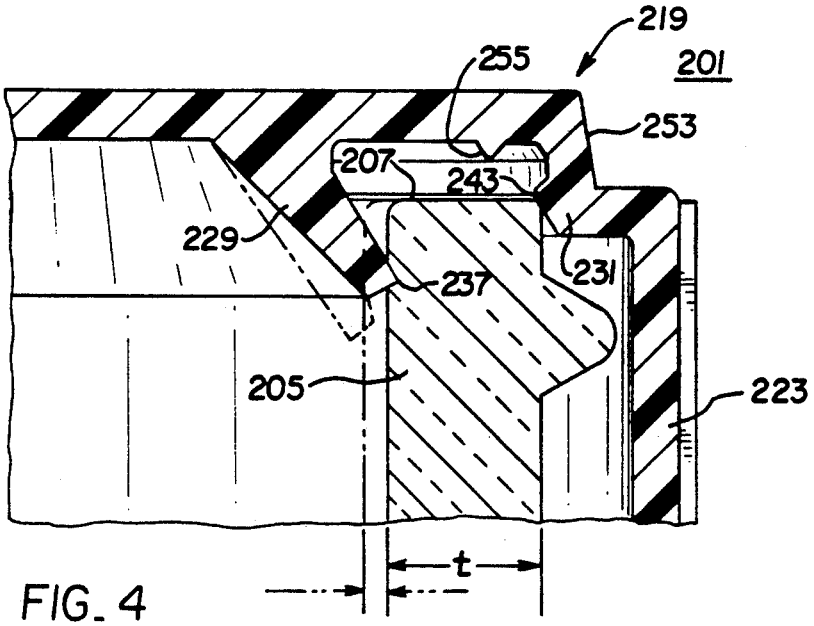
FIG. 4 is a fragmentary vertical section through yet another embodiment of a closure in accordance with the invention.

FIG. 4 illustrates yet another embodiment of the closure 201 in accordance with the invention in which the outer annular member 231 is formed on an inwardly stepped portion 253 of the skirt 223. In addition, the outer sealing edge 243 is vertically displaced above the inwardly directing sealing edge 237 of the inner annular flange member 229. The longer inner flange member 229 accommodates larger tolerances in the thickness t of the container wall 205 as illustrated in phantom in FIG. 4. The cap 219 of FIG. 4 also incorporates a third seal formed by an annular rib 255 on the inner surface of the end wall 221 which seats against the rim 207 of the container wall 205 when the closure is fully screwed onto the container. This additional sealing rib can be provided in any of the embodiments of the invention.

Figure 5:
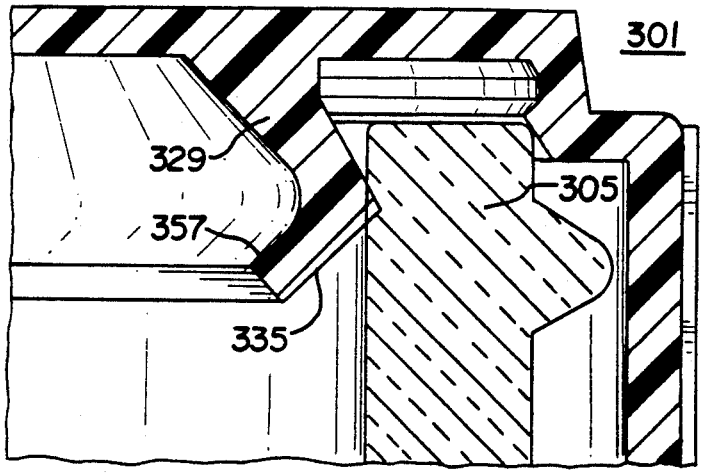
FIG. 5 is a fragmentary vertical section illustrating a variation of the embodiment of the closure shown in FIG. 4 suitable for use with glass containers.

FIG. 5 illustrates a modification to the embodiment of the closure shown in FIG. 4. In this closure 301, the inner annular flange 329 is also elongated and is provided with a foot 357 which lengthens the end face 335. This arrangement permits the closure 301 to be used with glass containers in which as is known, it is very difficult to control the inner dimension of the container wall 305.

Figure 6:
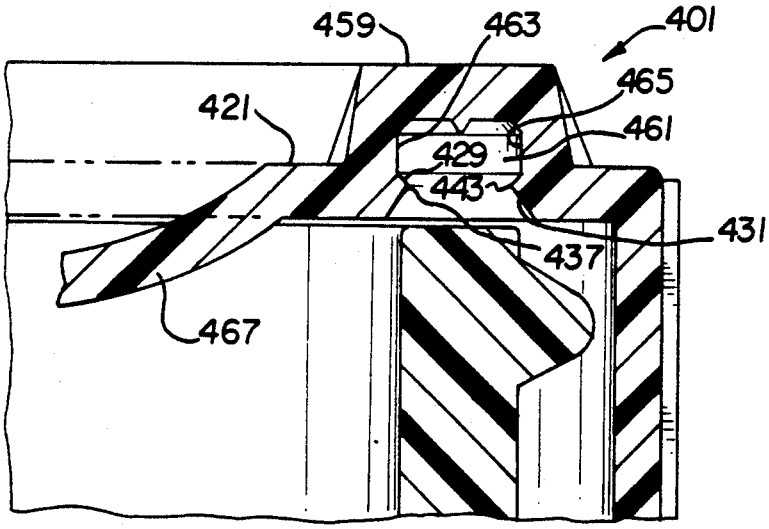
FIG. 6 is a fragmentary vertical section through still another embodiment of the invention suitable for sealing containers storing products under pressure, with the effect of pressure on the closure shown in phantom line.

FIG. 6 illustrates still another embodiment of the invention suitable for sealing containers storing products under pressure. The end wall 421 has an annular raised section 459 which forms an annular downwardly facing groove 461. The inner annular member 429 is formed on the inner wall 463 of the groove 461 while the outer annular member 431 is formed on the outer wall 465. The confronting sealing edges 437 and 443 are vertically aligned within the vertical thickness of the end wall 421. The closure 401 is molded with the center section 467 of the end wall 421 bulging convexly downward toward the container as shown in solid line in FIG. 6. When the closure 401 is applied to a container, and pressure builds up within the container, the downwardly convex section 467 is forced upward causing the center section to spread laterally thereby forcing the confronting sealing edges 443 and 437 toward each other to more tightly grip the inner and outer surfaces respectively of the container wall for a tighter seal.

Figure 7:
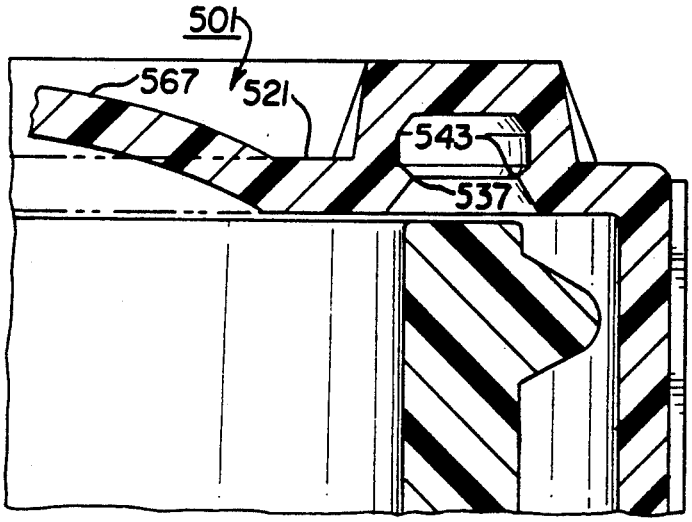
FIG. 7 is a fragmentary vertical section through a variation of the embodiment of FIG. 6 adapted for use with vacuum packed containers illustrating the effect of vacuum on the closure shown in phantom line.

FIG. 7 illustrates a modification of the closure of FIG. 6 for use with products which are vacuum packed in a container. In this closure 501, the center section 567 of the end wall 521 is molded convex upwardly away from the container. Thus, the vacuum in the container will draw the bulging center section 567 downward causing it to expand laterally and force the sealing edges 537 and 543 more tightly against the surfaces of the container sidewall for a tighter vacuum seal.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A linerless closure for a container having a cylindrical container wall of a given radial thickness with inner and outer cylindrical surfaces and terminating in a rim which defines a container opening, and having cap engaging means on said outer cylindrical surface spaced from said rim, said linerless closure comprising:

a cap adapted to be removably secured to said container by said cap engaging means to close said container opening;

a first annular member on said cap having a frusto-conical outer surface extending downwardly and outwardly, and a downwardly and inwardly directed frusto-conical end face which intersects said outer surface to form an annular radially outwardly directed sealing edge; and a second annular member on said cap having a downwardly and inwardly directed frusto-conical upper surface and a downwardly and outwardly directed frusto-conical end face which intersects said upper face to form an annular radially inwardly directed sealing edge;

said annular radially outwardly directed sealing edge and said annular radially inwardly directed sealing edge being substantially horizontally aligned in confronting relation and spaced radially a distance adapted to be less than the given radial thickness of said container wall with said annular radially outwardly directed sealing edge adapted to engage and make a line contact seal with the inner cylindrical surface of said container wall below said rim when said cap is secured to said container, and said annular radially inwardly directed sealing edge on said second annular member adapted to engage and make a line contact seal with the outer cylindrical surface of said container wall below said rim when said cap is secured to said container, said end face on said first annular member forming a first lead angle adapted to engage said container wall, said end face on the second annular member forming a second lead angle adapted to engage said container wall, and one of said lead angles being smaller than the other.

2. The closure of claim 1 wherein said second lead angle is smaller than said first lead angle.

3. In combination, a container having a cylindrical container wall of a given radial thickness with inner and outer cylindrical surfaces and terminating in a rim which defines a container opening, and having cap engaging means on said outer cylindrical surface spaced from said rim; and a linerless closure comprising:

a cap removably secured to said container by said cap engaging means to close said container opening, and having an end wall and a cylindrical skirt extending from said end wall;

a first annular member on said cap comprising an annular flange extending from said end wall and having a frusto-conical outer surface extending downwardly and outwardly, and a downwardly and inwardly directed frusto-conical end face which intersects said outer surface to form an annular outwardly directed sealing edge; and a second annular member on said cap having a downwardly and inwardly directed frusto-conical upper surface and a downwardly and outwardly directed frusto-conical end face with intersects said upper face to form an annular inwardly directed sealing edge, said annular radially outwardly directed sealing edge and said annular radially inwardly directed sealing edge being spaced radially a distance less than the radial thickness of said container wall with said annular radially outwardly directed sealing edge engaging and making a line contact seal with the inner cylindrical surface of said container wall below said rim with said cap secured to said container, and said annular radially inwardly directed sealing edge of said second annular member engaging and making a line contact seal with the outer cylindrical surface of said container wall below said rim with said cap secured to said container, said end wall of said cap having a center section inside said annular flange which is molded with a bulge and which flattens out due to a pressure differential between pressure inside the container and ambient pressure to force said annular flange radially outward and urge said annular outwardly directed sealing edge radially outward toward said annular inwardly directed sealing edge.

4. A linerless closure for a container having a cylindrical container wall of a given radial thickness with inner and outer cylindrical surfaces and terminating in a rim which defines a container opening, and having cap engaging means on said outer cylindrical surface spaced from said rim, said linerless closure comprising:

a cap adapted to be removably secured to said container by said cap engaging means to close said container opening, said cap having an end wall and a cylindrical skirt extending from said end wall;

a first annular member on said cap in the form of a first annular flange extending downward from said end wall and radially outward toward said skirt and terminating radially outward in an annular radially outwardly directed edge; and a second annular member on said cap in the form of a second annular flange extending downward from said end wall and radially inward away from said skirt and terminating radially inward in an annular radially inwardly directed sealing edge;

said annular radially outwardly directed sealing edge and said annular radially inwardly directed sealing edge being substantially horizontally aligned in confronting relation and spaced radially a distance adapted to be less than the given radial thickness of said container wall with said annular radially outwardly directed sealing edge adapted to engage and make a line contact seal with the inner cylindrical surface of said container wall below said rim when said cap is secured to said container, and said annular radially inwardly directed sealing edge on said second annular member adapted to engage and make a line contact seal with the outer cylindrical surface of said container wall below said rim when said cap is secured to said container, said end face on said first annular member forming a first lead angle for said container wall, and said end face on the second annular member forming a second lead angle for said container wall, and wherein one of said lead angles is smaller than the other.

5. The closure of claim 4 wherein said second lead angle is smaller than said first lead angle.

6. A linerless closure for a container having a cylindrical container wall of a given radial thickness with inner and outer cylindrical surfaces and terminating in a rim which defines a container opening, and having cap engaging means on said outer cylindrical surface spaced from said rim, said linerless closure comprising:

a cap adapted to be removably secured to said container by said cap engaging means to close said container opening said cap having an end wall and a cylindrical skirt extending from said end wall, said end wall having an annular raised section forming a downwardly facing annular groove with inner and outer sidewalls;

a first annular member on said cap extending radially outward from the inner sidewall; and a second annular member on said cap extending radially inward from the outer sidewall defining annular radially inwardly directed sealing edge;

said annular radially outwardly directed sealing edge and said annular radially inwardly directed sealing edge being substantially horizontally aligned in confronting relation and spaced radially a distance adapted to be less than the given radial thickness of said container wall with said annular radially outwardly directed sealing edge adapted to engage and make a line contact seal with the inner cylindrical surface of said container wall below said rim when said cap is secured to said container, and said annular radially inwardly directed sealing edge of said second annular member adapted to engage and make a line contact seal with the outer cylindrical surface of said container wall below said rim when said cap is secured to said container.

7. The closure of claim 6 wherein said first annular member has a downwardly and outwardly diverging frusto-conical upper surface and a downwardly and inwardly diverging frusto-conical lower face which intersects said upper surface to form said annular radially inwardly directed sealing edge, and wherein said second annular member has a downwardly and inwardly diverging frusto-conical upper surface and a downwardly and outwardly diverging frusto-conical lower face which intersects said upper surface, to form said annular inwardly directed sealing edge.

8. The closure of claim 7 wherein said annular outwardly directed sealing edge and said annular inwardly directed sealing edge are substantially horizontally aligned in confronting relation.

9. The closure of claim 8 wherein said lower face of said first annular member forms a first lead angle for said container wall and said lower face of said second annular member forms a second lead angle for said container wall.

10. The closure of claim 9 wherein said second lead angle is smaller than said first lead angle.

11. The closure of claim 6 wherein said end wall has a vertical thickness and wherein said annular inwardly directed sealing edge and said annular outwardly directed sealing edge are vertically within said vertical thickness of said end wall.

12. The closure of claim 11 wherein said end wall has a center section inside said annular section, said center section being molded convex downward and being flexible so that pressure within a container to which the closure is applied forces said center section upward causing it to spread laterally outward.

13. The closure of claim 12 wherein said first annular member has a downwardly and outwardly diverging frusto-conical upper surface and a downwardly and inwardly diverging frusto-conical lower face which intersects said upper surface to form said annular radially inwardly directed sealing edge, and wherein said second annular member has a downwardly and inwardly diverging frusto-conical upper surface and a downwardly and outwardly diverging frusto-conical lower surface which intersects said upper surface to form said annular inwardly directed sealing edge.

14. The closure of claim 13 wherein said annular outwardly directed sealing edge and said annular inwardly directed sealing edge are substantially horizontally aligned in confronting relation and wherein said lower face of said first annular member forms a first angle for said container wall and said lower face of the second annular member forms a second lead angle for said container wall.

15. The closure of claim 14 wherein said second lead angle is smaller than said first lead angle.

16. The closure of claim 11 wherein said end wall has a center section inside said annular section, said center section being molded convex upward and being flexible so that a vacuum within a container to which the closure is adapted to be applied pulls the center section downward causing it to spread laterally outward.

17. The closure of claim 16 wherein said first annular member has a downwardly and outwardly diverging frusto-conical upper surface and a downwardly and inwardly diverging frusto-conical lower face which intersects said upper surface to form said annular radially inwardly directed sealing edge, and wherein said second annular member has a downwardly and inwardly diverging frusto-conical upper surface and a downwardly and outwardly diverging frusto-conical lower surface which intersects said upper surface to form said annular inwardly directed sealing edge.

* * * * *